US006626608B2

(12) United States Patent
Olynyk

(10) Patent No.: US 6,626,608 B2
(45) Date of Patent: Sep. 30, 2003

(54) MOBILE ROCK CRUSHER

(76) Inventor: Jerry Olynyk, RR# 1, Site 35, Compartment 7, Keremeos, British Columbia (CA), V0X 1N0

( * ) Notice: Subject to any disclaimer, the term of this patent is extended or adjusted under 35 U.S.C. 154(b) by 46 days.

(21) Appl. No.: 09/974,790

(22) Filed: Oct. 12, 2001

(65) Prior Publication Data

US 2002/0044828 A1 Apr. 18, 2002

Related U.S. Application Data

(60) Provisional application No. 60/239,940, filed on Oct. 16, 2000.

(51) Int. Cl.[7] ..... E01C 23/12

(52) U.S. Cl. ..... 404/91; 404/90; 404/92; 241/101.763

(58) Field of Search ..... 404/72, 81, 75, 404/83, 90, 91, 92, 101, 113; 209/420, 421, 234, 235, 307, 308; 241/101.763, 81

(56) References Cited

U.S. PATENT DOCUMENTS

| | | | | |
|---|---|---|---|---|
| 3,622,089 A | * | 11/1971 | Quinn | 241/75 |
| 3,647,150 A | * | 3/1972 | Stephanek | 241/75 |
| 3,841,570 A | * | 10/1974 | Quinn | 241/78 |
| 3,927,839 A | * | 12/1975 | Quinn | 241/76 |
| 3,962,804 A | | 6/1976 | Hyler | |
| 3,964,719 A | * | 6/1976 | Hally et al. | 241/101.763 |
| 4,018,540 A | * | 4/1977 | Jackson, Sr. | 404/95 |
| 4,328,630 A | | 5/1982 | Hood et al. | |
| 4,381,827 A | | 5/1983 | Blackmore et al. | |
| 4,548,275 A | * | 10/1985 | Squier | 171/14 |

(List continued on next page.)

FOREIGN PATENT DOCUMENTS

| | | | |
|---|---|---|---|
| CA | 1008025 | 4/1977 | |
| CA | 1025399 | 1/1978 | |
| CA | 1027522 | 3/1978 | |
| CA | 1028290 | 3/1978 | |
| CA | 1040144 | 10/1978 | |
| CA | 1060392 | 8/1979 | |
| CA | 1063069 | 9/1979 | |
| CA | 1086265 | 9/1980 | |
| CA | 2049064 | 9/1990 | |
| EP | 1136130 A2 * | 9/2001 | B02C/21/02 |

OTHER PUBLICATIONS

TEREX, Motor Scraper TS14G, Form No. 790 May 2000.

*Primary Examiner*—Thomas B. Will
*Assistant Examiner*—Alexandra K. Pechhold
(74) *Attorney, Agent, or Firm*—Anthony C. Edwards

(57) ABSTRACT

A mobile rock crusher for crushing raw rock material which has been windrowed on a roadway in the translation path of the crusher includes a rigid supporting structure, which includes a frame, and translation means for allowing translation of the frame over the roadway. A selectively actuable scoop is pivotally mounted to the frame for selectively actuable lowering over the roadway into sliding engagement with, so as to collect, the windrowed raw rock material onto the scoop. A first conveyor is mounted to the frame. An upstream loading end of the first conveyor cooperates with the scoop for conveying the raw rock material from the scoop onto a first screen at a downstream depositing end of the first conveyor. The first screen is for screening larger diameter material from smaller diameter material in the raw rock material so that the smaller diameter material falls through the first screen. The larger diameter material translates over the first screen so as to fall into a first crusher mounted to the frame beneath the first screen. A second conveyor mounted to the frame beneath the first crusher is for conveying crushed material from the first crusher into a second crusher mounted to the frame for crushing the crushed material for deposition from the second crusher onto the roadway.

10 Claims, 5 Drawing Sheets

U.S. PATENT DOCUMENTS 4,598,875 A * 7/1986 Bronson et al. ..... 241/78
4,637,753 A 1/1987 Swisher, Jr.
4,928,890 A * 5/1990 Swisher, Jr. ..... 241/24.1
4,944,631 A 7/1990 Egli
4,946,307 A * 8/1990 Jakob ..... 404/92
4,948,299 A * 8/1990 Cronk et al. ..... 405/179
5,332,164 A 7/1994 Page
5,441,361 A 8/1995 Campbell
5,566,893 A * 10/1996 Getz ..... 241/27
5,921,706 A 7/1999 Manatt et al.
5,938,373 A * 8/1999 Scudder ..... 405/179
5,988,937 A 11/1999 Komoriya et al.
6,000,554 A * 12/1999 Hughes ..... 209/314
6,098,812 A * 8/2000 Douglas ..... 209/420
6,382,425 B1 * 5/2002 Brickner et al. ..... 209/421
2001/0054657 A1 * 12/2001 Moriya et al. ..... 241/101.74
2002/0157840 A1 * 10/2002 Theurer et al. ..... 171/16

* cited by examiner

MOBILE ROCK CRUSHER

CROSS REFERENCE TO RELATED APPLICATION

This application claims priority from U.S. Provisional Patent Application No. 60/239,940 filed Oct. 16, 2000 entitled Self-Propelled Rock Crusher.

FIELD OF THE INVENTION

This invention relates to rock crushing equipment which produces aggregate for use during the construction of roadways. More specifically, the invention relates to a self-propelled rock crusher for producing aggregate suitable for the subbase of a roadway where the rock to be crushed can be blasted rock, boulders and cobbles normally found within the right-of-way of the road being constructed. The aggregate is deposited along the length of the roadway as construction progresses.

BACKGROUND OF THE INVENTION

During the construction of roads and highways, large volumes of aggregate having specific gradation and compaction specifications are required for producing a firm, stable and moisture resistant load bearing road bed. The road bed in most cases comprises a subgrade, a subbase and a base layer over which a bituminous surface is spread.

Aggregate meeting the specifications for roadway construction is usually produced by crushing rock material in a stationary crushing machine that is permanently located at a remote site where a large volume of such suitable rock material is in existence. A site having such suitable material is usually remotely located from the site of the roadway under construction, thereby requiring that the aggregate be loaded on to trucks and transported to the roadway construction site as required.

The present invention reduces the cost, transportation and timing or scheduling of rock deliveries to the roadway site during the initial stages of roadway construction by providing a self-propelled rock crushing machine capable of producing aggregate on site which meets the specifications for the initial subgrade layer of the roadbed from native material found within the roadway right-of-way. The self-propelled rock crusher can readily travel along the length of the roadway to scoop-up and crush rock material which has been loosened and collected into windrows by earth moving equipment such as graders or the like. The rock crusher then deposits the crushed material on the surface of the roadway for subsequent spreading and compaction.

SUMMARY OF THE INVENTION

A tractor unit tows a rock crushing apparatus mounted on a separate frame. The tractor unit is conventionally pivotally mounted to the frame so as to provide mobility for the frame. The tractor unit has positioned within reach of the operator an electrical control panel through which the crushing apparatus can be remotely operated and regulated. Hydraulic controls permit the operator to raise or lower the forward end of the frame to control the position of an inlet portion of the crushing apparatus relative to the ground surface of the roadway.

The crushing apparatus is operated by a number of electrical motors which receive electrical power from a diesel generator mounted on the rear frame. The electrical motors drive several rock moving conveyors to transport material to be crushed from the surface of the roadbed to a first coarse rock crusher then to a second fine rock crusher for deposition to the ground. Also mounted on the frame, in proximity to the diesel generator, are separate compartments containing transformers, breakers and relays as would normally be associated with an electric drive system.

In summary, the mobile rock crusher of the present invention for crushing raw rock material which has been windrowed on a roadway in the translation path of the crusher includes a rigid supporting structure, which includes a frame, and translation means for allowing translation of the frame over the roadway. A selectively actuable scoop is pivotally mounted to the frame for selectively actuable lowering over the roadway into sliding engagement with, so as to collect, the windrowed raw rock material onto the scoop. A first conveyor is mounted to the frame. An upstream loading end of the first conveyor cooperates with the scoop for conveying the raw rock material from the scoop onto a first screen at a downstream depositing end of the first conveyor. The first screen is for screening larger diameter material from smaller diameter material in the raw rock material so that the smaller diameter material falls through the first screen. The larger diameter material translates over the first screen so as to fall into a first crusher mounted to the frame beneath the first screen. A second conveyor mounted to the frame beneath the first crusher is for conveying crushed material from the first crusher into a second crusher mounted to the frame for crushing the crushed material for deposition from the second crusher onto the roadway. The first conveyor may be pivotally mounted to the frame and selectively actuable so as to pivot the scoop and first conveyor into engagement with the roadway.

In one embodiment, a second screen is mounted to the frame and beneath the first crusher for screening fines from crush resulting from the larger diameter material being crushed in the first crusher. The second screen may be inclined so that the crush slides from the second screen onto the second conveyor.

In another embodiment, a third screen is mounted to the frame and beneath a downstream depositing end of the second conveyor. The third screen is for screening further fines from the crush. The third screen may be inclined so that the crush slides from the third screen into the second crusher. A first conduit may be mounted beneath the first screen for directing the smaller diameter material out from a flow path of the larger diameter material passing into the first crusher so that the smaller diameter material falls to the roadway. Second and third conduits may be mounted beneath the second and third screens respectively for directing the fines and the further fines respectively out of a flow path of the crush so as to fall to the roadway.

A hopper may be mounted at the depositing end of the first conveyor, the hopper for directing the raw rock material for deposit onto the first screen. A hopper conveyor may also be mounted under the depositing end of the first conveyor so that the first screen is fed by the hopper conveyor. The hopper conveyor may translate the raw rock material in a forward direction relative to the forward end of the frame. A first guide may be mounted beneath the depositing end of the first conveyor and in inclined opposed relation to the first screen so as to channel the raw rock material into the first crusher. Second and third guides may be mounted in inclined opposed relation to the second and third screens respectively for channelling the crush along the flow path of the crush.

In one embodiment the first crusher may be a jaw crusher the second crusher may be a roll crusher. In one preferred embodiment the first crusher is aft of the second crusher relative to a forward end of the frame, and the second conveyor transports the crush in a forward direction. In another preferred embodiment the first crusher is forward of the second crusher relative to the forward end of the frame, and the second conveyor transports the crush in a rearward direction.

The rock crusher of the present invention may also include material urging means cooperating with the scoop for urging the raw rock material onto the scoop and the first conveyor. The material urging means may be an actuable broom roller, rotatably mounted above the scoop.

The rock crusher of the present invention may further include a tractor means mounted to the forward end of the frame. The tractor means may be a self-powered two wheel tractor pivotally mounted to the forward end of the frame. The translation means may be at least one pair of rear wheels mounted on the frame.

Both the screen and the crushers may be hopper-fed from hoppers mounted to catch and channel material moving along the processing path.

DETAILED DESCRIPTION OF EMBODIMENTS OF THE INVENTION

Figure 1:
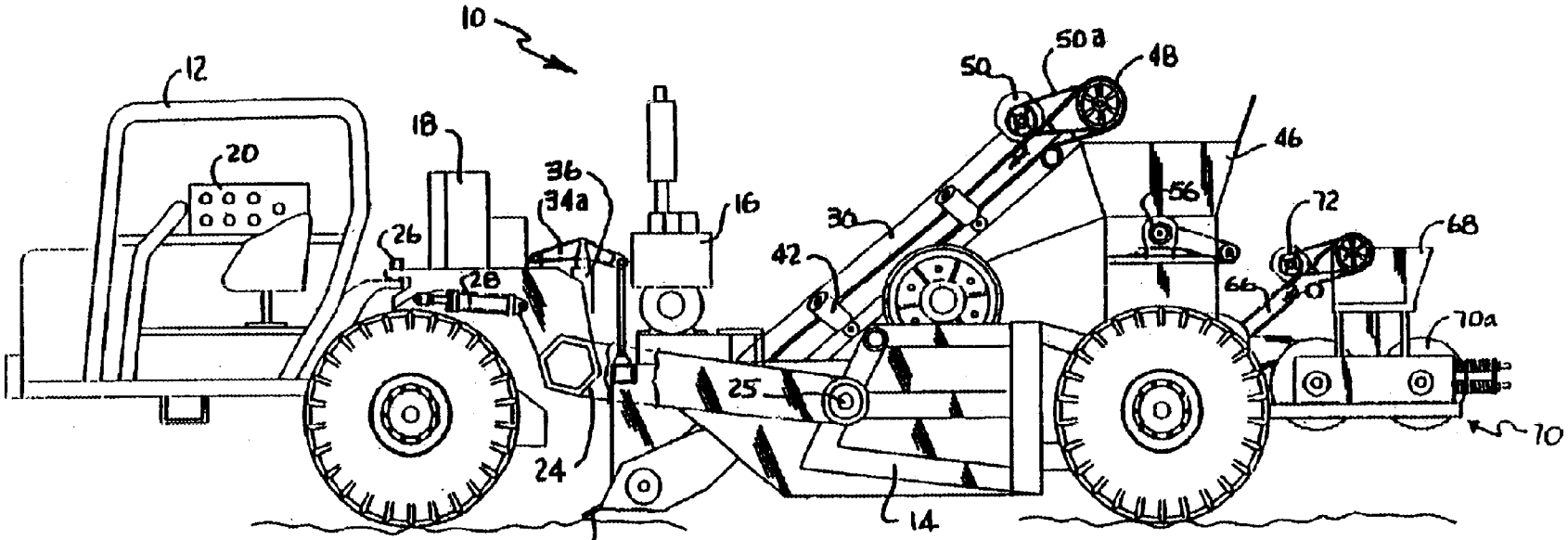
FIG. 1 is a side elevational view of the rock crusher of the present invention.
Figure 2:
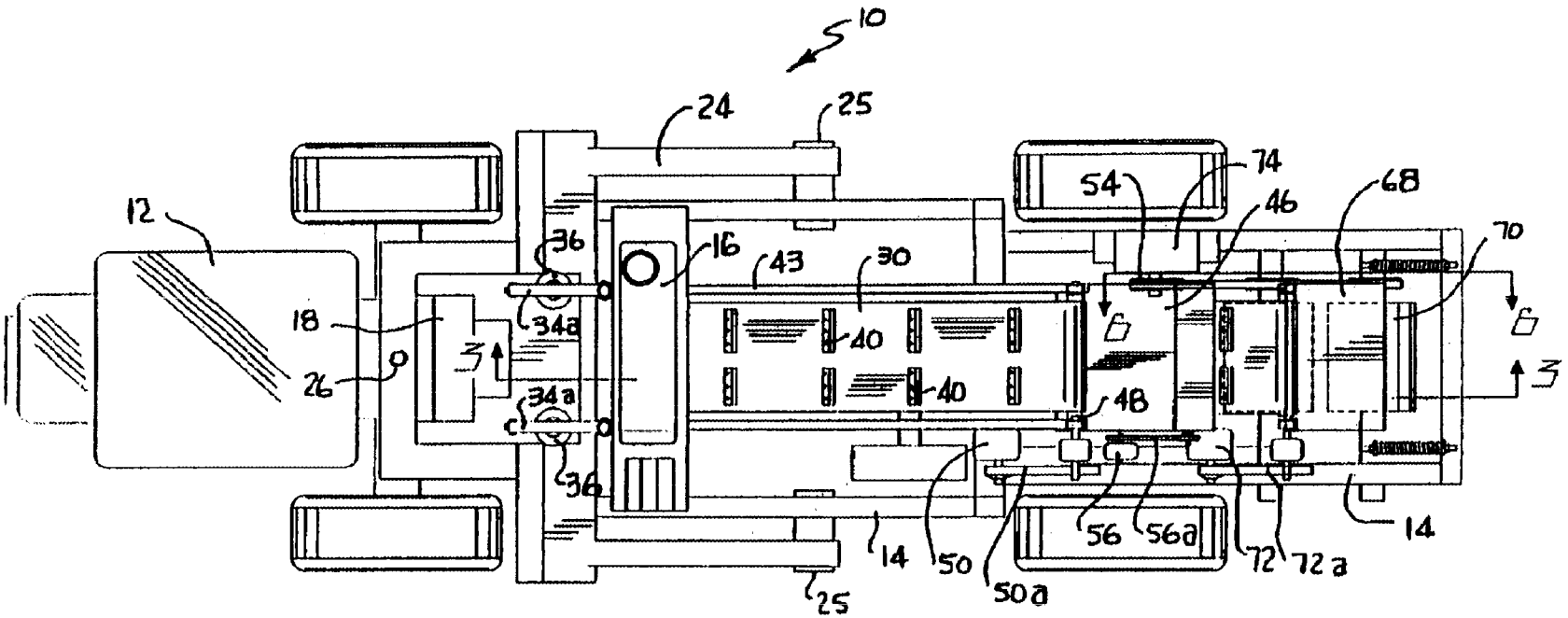
FIG. 2 is a plan view of the rock crusher of FIG. 1.

As seen in FIGS. 1 and 2, the mobile rock crusher 10 of the present invention may have a tractor means such as the forwardly positioned self-propelled tractor unit 12 which provides self-propelled mobility to a rigid supporting structure which includes frame 14. The supporting structure and Frame 14 is mobile by the operation of translation means such as the pair of rear wheels illustrated, although this is not intended to be limiting. Self contained crushing machinery is mounted on frame 14. The crushing machinery is operated by electricity produced through a diesel generator 16. Such electricity is firstly directed to conventional transformers, breakers and relays contained in a regulating compartment 18. Secondly, the electricity is routed to a control panel 20 mounted on tractor unit 12 within reach of the operator (not shown). Control panel 20 allows the electrical power to be selectively provided to electrical motors 50 and 72 which operate the crushing machinery on frame 14. Frame 14 is pivotally mounted or mountable to tractor unit 12 through forward yolk 24. The forward end of yolk 24 is pinned to tractor 12 by pin 26. Hydraulic actuators 28 rotate tractor 12 relative to yolk 24 about pin 26. Frame 14 is mounted to yolk 24 on pivot pins 25.

Figure 3:
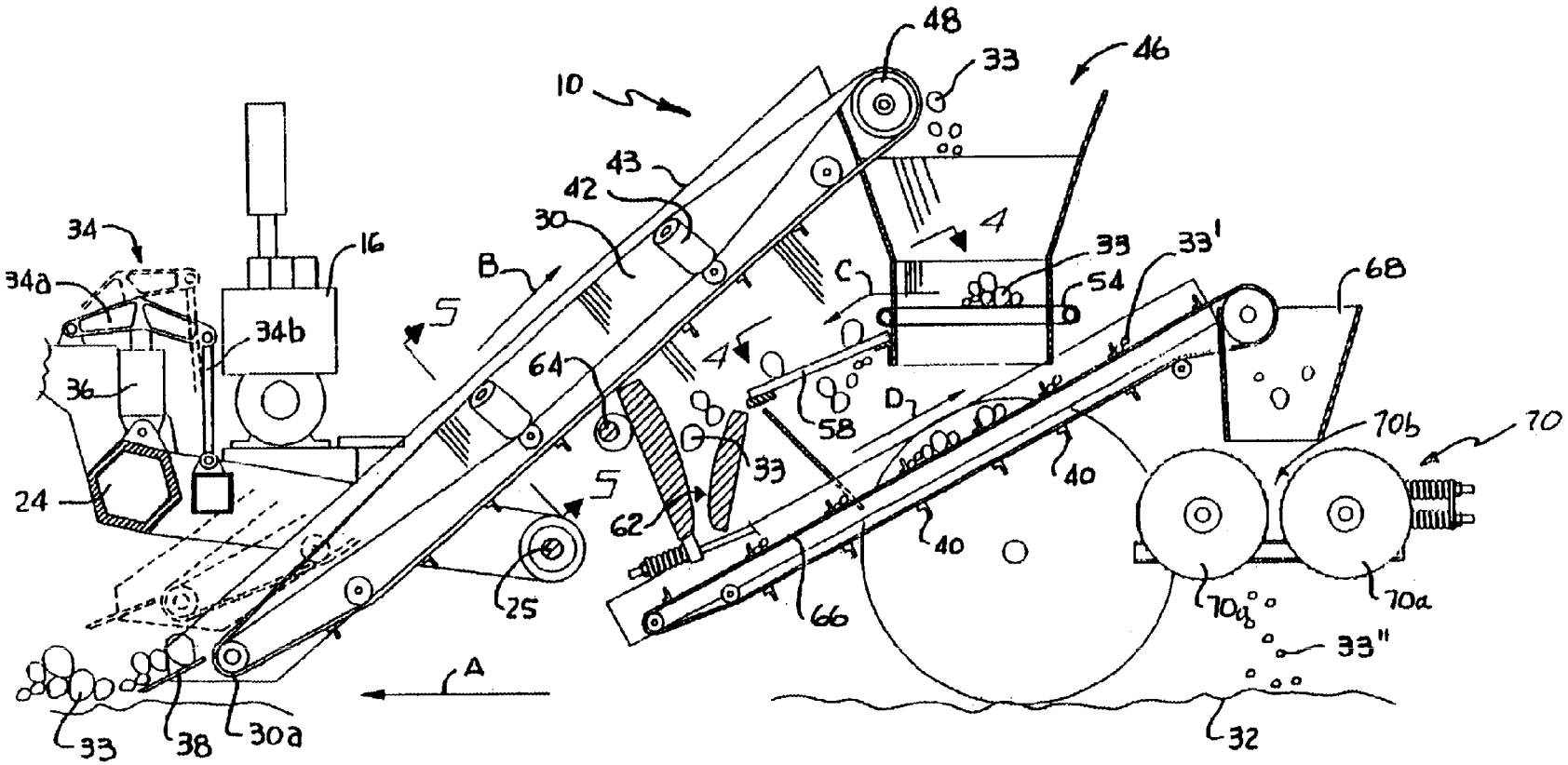
FIG. 3 is a sectional view taken on line 3—3 of FIG. 2.

As also seen in FIG. 3, the crushing machinery includes a first endless belt conveyor 30, mounted generally along the longitudinal median of frame 14. Forward end 30*a* of first conveyor 30 is selectively elevatable in a generally vertically plane by operation of hydraulic cylinder 36 pivotally mounted on forward yolk 24 acting through linkage 34. Linkage 34 includes a rocker arm 34*a* and rods 34*b*. Rocker arm 34*a* is pivotally mounted at one end to yolk 24 and at its other end to a forward end of frame 14 through lifting rods, bars or struts 34*b*. Actuation of cylinder 36 rotates rocker arm 34*a* relative to yoke 24 and translates rods 34*b* resulting in rotation or pivoting of frame 14 about pivot pins 26 to vertically reposition first conveyor 30 and in particular forward end 30*a*.

Figure 3A:
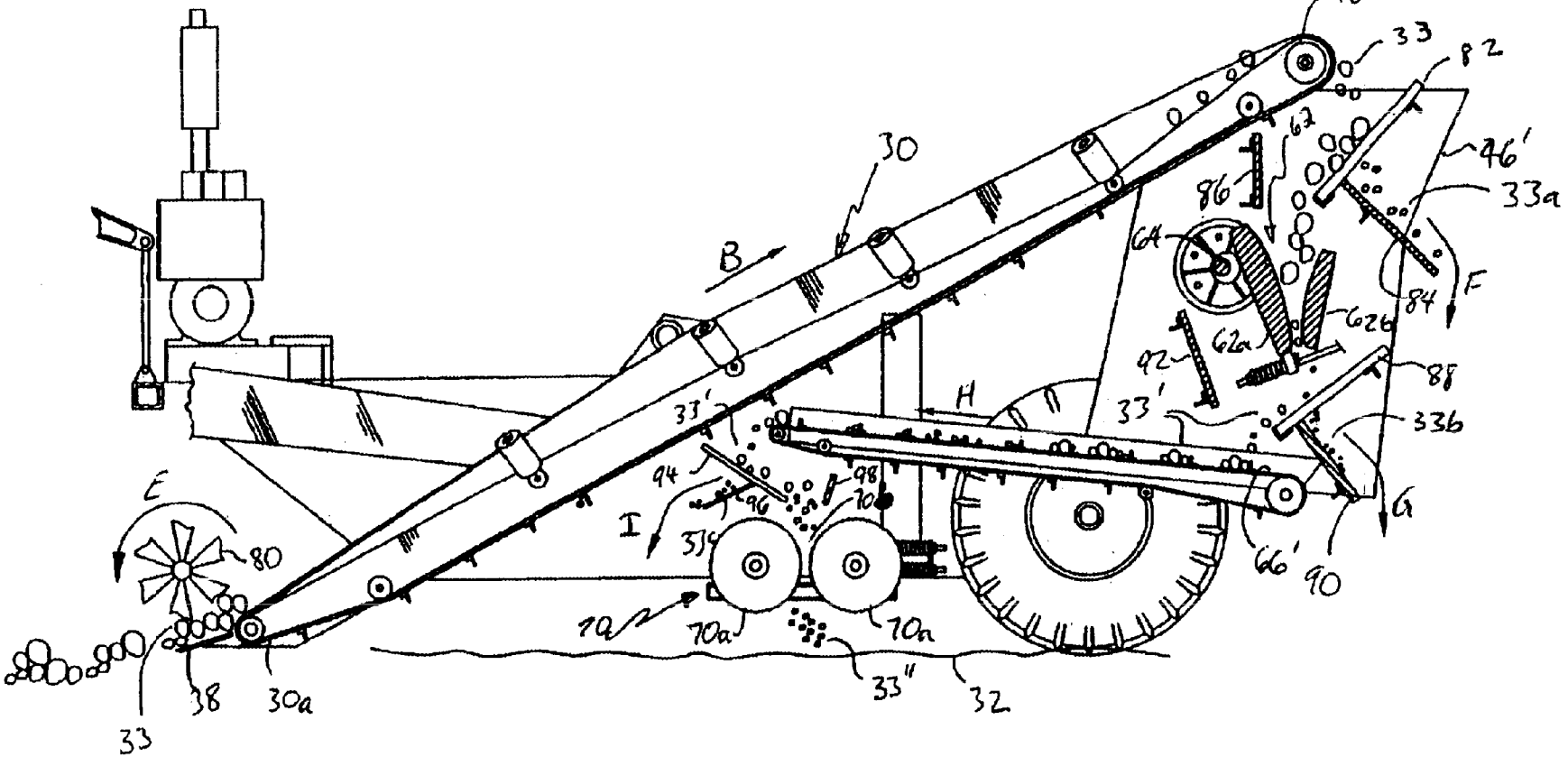
FIG. 3*a* is a view corresponding to the view of FIG. 3 of an alternative embodiment of the rock crusher of the present invention.

As frame 14 is translated forwardly on a translation path in direction A along a roadbed 32, forward end 30*a* of first conveyor 30 is vertically positioned to scoop windrowed boulders, cobbles or the like (hereinafter rock material 33) which have been loosened from the roadbed and collected into windrows by earth moving equipment (not shown). This material is picked up by a forwardly inclined horizontally disposed platform 38, and passes onto forward end 30*a* of first conveyor 30. As seen in FIG. 3*a*, material urging means such as a hydraulic auger or broom roller 80 may be mounted to frame 14 and hydraulically driven so as to rotate in direction E in co-operation with platform 38. Broom roller 80 assists platform 38 in its function as a scoop loading material 33 onto the front end 30*a* of conveyor 30.

Figure 5:
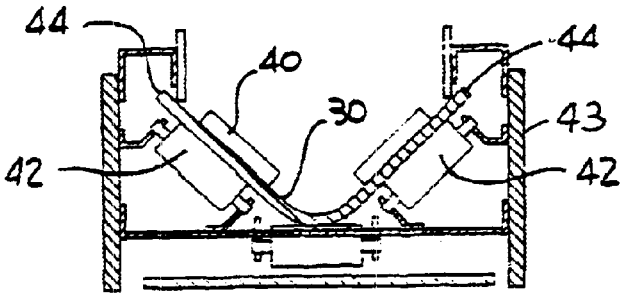
FIG. 5 is a sectional view taken on line 5—5 of FIG. 3.

Conveyor 30 is manufactured from durable, flexible material as would be known to one skilled in the art. It extends generally across the width of inclined platform 38 and extends rearwardly and upwardly therefrom to its depositing end. Flexible paddles 40 (as better seen FIG. 5) mounted about the circumference of conveyor 30 assist in moving the rock material 33 from roadbed 32 up the incline of first conveyor 30 in direction B. Inclined side rolls 42 mounted to conveyor housing 43 beneath conveyor 30 deform the side edges 44 of conveyor 30 so as to bow conveyor 30 about the longitudinal medial center line of the conveyor to prevent spillage of rock material 33 as it travels along the conveyor. Conveyor 30 deposits rock material 33 from its depositing end into surge hopper 46 in the embodiment of FIG. 3, and into housing 46' in the embodiment of FIG. 3*a*. Hopper 46 and housing 46' have sufficient capacity to compensate for variations in the volume of rock material 33 picked up by conveyor 30. Conveyor 30 passes over drive roller 48. Drive roller 48 is driven by electric drive motor 50 via drive belt 50*a*.

Figure 4:
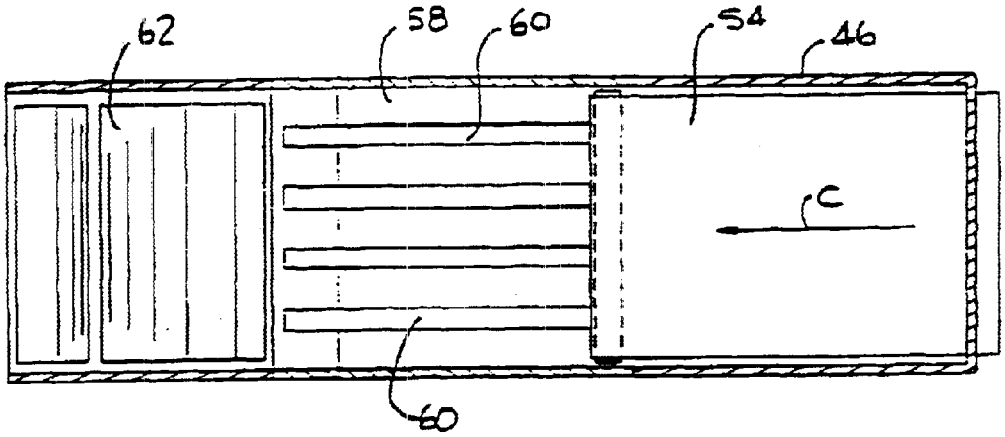
FIG. 4 is a sectional view taken on line 4—4 of FIG. 3.
Figure 6:
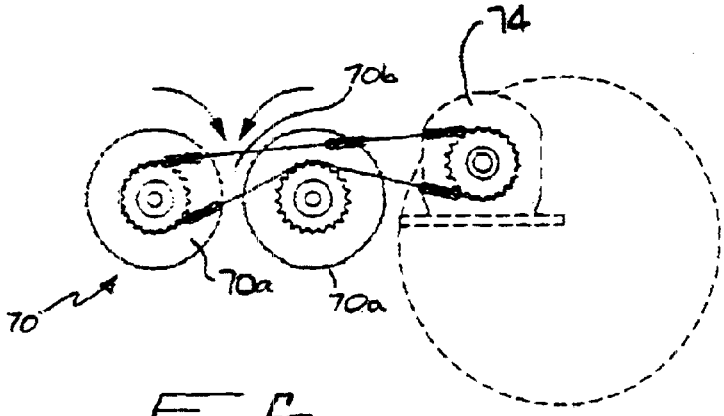
FIG. 6 is a sectional view taken on line 6—6 of FIG. 2.

In the embodiment of FIG. 3, raw rock material 33 within surge hopper 46 is moved horizontally along the floor thereof, in direction C on a hopper conveyor 54. In one embodiment, a gate (not shown) may be mounted in the downstream wall of hopper 46. Partially opening or closing the gate regulates the volume of flow of material 33 from the hopper on conveyor 54. Conveyor 54 is driven by electric drive motor 56 via drive belt 56*a*. Raw rock material 33 exiting from conveyor 54 falls onto a first screen such as a separator or "grizzly" 58, comprising a plurality of laterally spaced apart rods 60 as better seen in FIG. 4. Separator 58 allows only rock material 33 which has a diameter greater than the lateral distance between the rods 60 to be directed by gravity over the top surface of the separator 58 to a first crush such as a coarse, jaw-type crusher 62 for reduction of rock material 33 into smaller sized particles 33'. Jaw crusher 62 is generally in the shape of an inverted cone, one side of which is cyclically agitated by eccentrically lobed shaft 64. In this embodiment, both small diameter material 33 passing through the grid of rods 60 in separator 58, and larger diameter material 33 which passes through jaw crusher 62 (collectively rock material 33'), falls by gravity onto a second conveyor 66. Conveyor 66 carries the smaller diameter rock material 33 rearwardly (relative to the front of frame 14) to a second hopper 68 which feeds material 33' into a second crusher such as a counter-rotating drum crusher 70, also shown in FIG. 6, mounted at the rear of frame 14. Conveyor 66 is driven by electric drive motor 72 via drive belt 72*a*. Conveyor 66 may also have flexible paddles 40 mounted about its circumference to assist in moving rock material 33' up inclined conveyor 66 in direction D.

In the embodiment of FIG. 3*a*, raw rock material 33 falling from the depositing end of conveyor 30 into housing 46' is directed against an upper inclined screen 82 so as to initially screen fines 33*a* from material 33. Fines 33*a* drop through screen 82 and are directed by first conduit such as conduit 84 from housing 46', for example rearwardly in direction F so as to fall down onto road bed 32. The remainder of material 33 slides off screen 82 and is channelled between a first guide such as guide 86 and screen 82 so as to fall between jaws 62*a* and 62*b* of a first crusher such as jaw crusher 62. Guide 86 and screen 82 are in opposed inclined relation to another to form a funnel. As in the embodiment of FIG. 3, jaw 62*a* oscillates relative to fixed jaw 62*b* by the action of a rotating eccentric shaft 64. Again, crusher 62 reduces the particle sizes of material 33 into smaller particles 33'. Material 33' falling from the lower end of crusher 62 is directed against a second screen such as lower inclined screen 88 which, similar to the operation of screen 82, allows fines 33*b* to pass through the screen so as to be directed from housing 46' by a second conduit such as conduit 90 in direction G. Crush material 33' (alternatively referred to as simply crush) is channelled between screen 88 and a second guide such as guide 92 onto conveyor 66'. Material 33' on conveyor 66' is conveyed forwardly in direction H so as to be deposited from the forward or depositing end of conveyor 66' onto a third screen such as screen 94. Further fines 33*c* are screened from material 33' so as to fall through screen 94 and be directed by conduit 96 in direction I onto the roadway. The remainder of the material is channelled by the inclination of screen 94 and a third guide such as guide 98 into a second crusher such as into the nip 70*b* between the drums 70*a* of drum crusher 70. Material 33' is channelled between screen 94 and guide 98 into nip 70*b* so as to be crushed by drum crusher 70. The second and third guides are in opposed inclined relation to the second and third screens respectively so as to form funnels. Thus as may be seen, in this embodiment material 33 is screened and filtered in stages. A primary screening removes primary fines prior to pre-crushing by a jaw crusher, whereupon secondary screening removes secondary fines from the crush prior to a third screening to remove remaining fines from the crush prior to final crushing in a drum or roll crusher. In this fashion, the volume of crush is reduced by sequential screening so as to reduce the volume of material required to be crushed by the drum or roll crusher.

Drum crusher 70 is operated by a separate electric drive motor 74. Drum crusher 70 discharges further crushed material 33" meeting the specifications for roadway subgrade directly onto roadbed 32 for spreading and compaction by ancillary road building equipment.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A mobile rock crusher for crushing raw rock material which has been windrowed on a roadway in the translation path of the crusher, comprising:

(a) a rigid supporting structure including a frame and translation means for allowing translation of said frame over the roadway, (b) a selectively actuable scoop pivotally mounted to the frame for selectively actuable lowering over roadway into sliding engagement with, so as to collect, the windrowed raw rock material onto the scoop;

(c) a first conveyor mounted to the frame, an upstream loading end of said first conveyor cooperating a with said scoop for conveying said raw rock material from said scoop onto a first screen at a downstream depositing end of said first conveyor, said first screen for screening larger diameter material from smaller diameter material in said raw rock material so tat said smaller diameter material falls through said first screen, and so that said larger diameter material translates over said first screen so as to fall into a first crusher mounted to said frame beneath said first screen, (d) a second conveyor mounted to said frame beneath said first crusher for conveying crushed material from said first crusher into a second crusher mounted to said frame for crushing said crushed material for deposition from said second crusher onto the roadway, said crusher further comprising a second screen mounted to said frame and beneath said first crusher for screening fines from crush resulting from said larger diameter material being crushed in said first crusher, said second screen inclined so that said crush slides from said second screen onto said second conveyor.

2. The rock crusher of claim 1 further comprising a third screen mounted to said frame and beneath a downstream depositing end of said second conveyor, said third screen for screening further fines from said crush, said third screen inclined so that said crush slides from said third screen into said second crusher.

3. The rock crusher of claim 2 further comprising a first conduit mounted beneath said first screen for directing said smaller diameter material out from a flow path of said larger diameter material passing into said first crusher so as to fall to the roadway.

4. The rock crusher of claim 3 further comprising second and third conduits mounted beneath said second and third screens respectively for directing said fines and said further fines respectively out of a flow path of said crush so as to fall to the roadway.

5. The rock crusher of claim 2 further comprising a first guide mounted beneath said depositing end of said first conveyor and in inclined opposed relation to said first screen so as to channel said raw rook material into said first crusher.

6. The rock crusher of claim 5 further comprising second and third guides mounted in inclined opposed relation to said second and third screens respectively for channelling said crush along said flow path of said crush.

7. A mobile rock crusher for crushing raw rock material which has been windrowed on a roadway in the translation path of the crusher comprising:

(a) a rigid supporting structure including a frame and translation means for allowing translation of said frame over the roadway, (b) a selectively actuable scoop pivotally mounted to the frame for selectively actuable lowering over roadway into sliding engagement with, so as to collect, the windrowed raw rock material onto the scoop;

(c) a first conveyor mounted to the frame, an upstream loading end of said first conveyor cooperating a with said scoop for conveying said raw rock material from said scoop onto a first screen at a downstream depositing end of said first conveyor, said first screen for screening larger diameter material from smaller diameter material in said raw rock material so tat said smaller diameter material falls through said first screen, and so that said larger diameter material translates over said first screen so as to fall into a first crusher mounted to said frame beneath said first screen, (d) a second conveyor mounted to said frame beneath said first crusher for conveying crushed material from said first crusher into a second crusher mounted to said frame for crushing said crushed material for deposition from said second crusher onto the roadway, said crusher wherein said first crusher is forward of said second crusher relative to a forward end of said frame, and wherein said second conveyor transports said crash in a rearward direction, and wherein a hopper and hopper conveyor are mounted under said depositing end of said first conveyor, and said first screen is fed by said hopper conveyor.

8. The rock crust of claim 7 wherein said hopper conveyor translates said raw rock material in a forward direction relative to said forward end of said frame.

9. A mobile rock crusher for crushing raw rock material which has been windrowed on a roadway in the translation path of the crusher comprising:

(a) a rigid supporting structure including a frame and translation means for allowing translation of said frame over the roadway, (b) a selectively actuable scoop pivotally mounted to the frame for selectively actuable lowering over roadway into sliding engagement with, so as to collect, the windrowed raw rock material onto the scoop;

(c) a first conveyor mounted to the frame, an upstream loading end of said first conveyor cooperating a with said scoop for conveying said raw rock material from said scoop onto a first screen at a downstream depositing end of said first conveyor, said first screen for screening larger diameter material from smaller diameter material in said raw rock material so tat said smaller diameter material falls through said first screen, and so that said larger diameter material translates over said first screen so as to fall into a first crusher mounted to said frame beneath said first screen, (d) a second conveyor mounted to said frame beneath said first crusher for conveying crushed material from said first crusher into a second crusher mounted to said frame for crushing said crushed material for deposition from said second crusher onto the roadway, said crusher further comprising material urging means cooperating with said scoop for urging the raw rock material onto said scoop and said first conveyor, wherein said material urging means is an actuable broom roller, rotatably mounted above said scoop.

10. A mobile rock crusher for crushing raw rock material which has been windrowed on a roadway in the translation path of the crusher comprising:

(a) a rigid supporting structure including a frame and translation means for allowing translation of said frame over the roadway, (b) a selectively actuable scoop pivotally mounted to the frame for selectively actuable lowering over roadway into sliding engagement with, so as to collect, the windrowed raw rock material onto the scoop;

(c) a first conveyor mounted to the frame, an upstream loading end of said first conveyor cooperating a with said scoop for conveying said raw rock material from said scoop onto a first screen at a downstream depositing end of said first conveyor, said first screen for screening larger diameter material from smaller diameter material in said raw rock material so tat said smaller diameter material falls through said first screen, and so that said larger diameter material translates over said first screen so as to fall into a first crusher mounted to said frame beneath said first screen, (d) a second conveyor mounted to said frame beneath said first crusher for conveying crushed material from said first crusher into a second crusher mounted to said frame for crushing said crushed material for deposition from said second crusher onto the roadway, wherein said first conveyor is pivotally mounted to said frame and selectively actuable so as to pivot said scoop and first conveyor into engagement with the roadway.

* * * * *